US005193402A

United States Patent [19]

Reed

[11] Patent Number: 5,193,402

[45] Date of Patent: Mar. 16, 1993

[54] LEADWIRE ATTACHMENT TECHNIQUE FOR MANUFACTURING A THIN FILM SENSOR AND A SENSOR MADE BY THAT TECHNIQUE

[75] Inventor: Stuart E. Reed, Homeworth, Ohio

[73] Assignee: The Babcock & Wilcox Company, New Orleans, La.

[21] Appl. No.: 823,405

[22] Filed: Jan. 21, 1992

[51] Int. Cl.[5] ..... H01C 17/28

[52] U.S. Cl. ..... 73/862.625; 73/862.68; 73/862.627; 29/592.1; 29/621; 29/621.1; 29/854

[58] Field of Search ..... 73/862.625, 862.627, 73/862.68; 338/2; 29/592.1, 621, 621.1, 854, 855, 856

[56] References Cited

U.S. PATENT DOCUMENTS 3,002,457 10/1961 Doughty ..... 29/621

4,680,858 7/1987 Johnson ..... 29/621.1

*Primary Examiner*—P. W. Echols

*Attorney, Agent, or Firm*—Vytas R. Matas; Robert J. Edwards; Daniel S. Kalka

[57] ABSTRACT

A method for manufacturing a sensor with an attached leadwire (10) fastened to an adaptor block (18) which is attached to a gage shim (24). The sensor is deposited on an insulated layer (28) placed on the gage shim (24) in electrical contact with the electrical leads (16) of the leadwire (10). One or more passivation layers (36) are applied over the upper surface of the entire sensor to provide a complete seal.

10 Claims, 1 Drawing Sheet

LEADWIRE ATTACHMENT TECHNIQUE FOR MANUFACTURING A THIN FILM SENSOR AND A SENSOR MADE BY THAT TECHNIQUE

BACKGROUND OF THE INVENTION

1. Field of the Invention

The present invention relates generally to manufacturing a sensor with an attached leadwire, and more particularly to a method for manufacturing a thin film strain gage with the attachment of the leadwire directly to the gage shim.

2. Description of the Related Art

One of the major limitations in the performance of strain gages is often the attachment of the leadwire to the gage. There is a variety of attachment techniques which have been used on strain gages which include soldering and brazing techniques, wire bonding, and welding. Each of these techniques has inherent limitations.

Soldering and brazing introduce a foreign metallic alloy into the joint between the gage and the leadwire. This may result in offsets with temperature and drift with time. Both soldering and brazing require fluxing to obtain good wetting with strain gage and leadwire materials. The fluxes may cause local damage to the gage or leads during the joining process. Removal of all flux residue is essential to avoid corrosion of the joint and drift with time. Both soldering and brazing produce a local mass of material which result in a stress concentration in both the leadwire and the gage. Thus, the most likely place for failure to occur is in the leadwire or gage material adjacent to the joint, and the joint may exhibit significant strain sensitivity.

Wire bonding can be used to overcome some of these problems. In general, no fluxes are required, and the quantity of foreign material added is small. This technique thus minimizes the thermal offset problems and drift with time. Because the mass of material in the joint is small, stress concentration is minimized in the gage and wires. In a wire bonded joint, the likely location for failure is in the joint itself. To obtain reliable joints, this technique requires a high degree of surface cleanliness and freedom from oxidation. In general, a precious metal such as gold is used to create the bond. With some gage alloys such as a platinum-tungsten alloy, the precious metal is frequently solid-soluble in the gage alloy resulting in drift with time and temperature and a change in the characteristics of the gage itself.

Welding of the lead wire attachment eliminates the addition of foreign material in the joint and generally results in a physically strong joint. These joints may be made using only heat such as fusion or autogenous welding, or using a combination of heat and pressure such as thermo-compression bonding or spot welding. Because of the temperatures involved in these processes, local microstructural changes occur in the gage and leadwire alloys both in and near the joint. Since welding is a fusion process, the joint contains new alloys made up of the components of the gage material and the leadwire material and material composition gradients. The joints also have relatively high residual stress levels. As a result, these joints are prone to corrosion damage and fatigue cracking. It is difficult to insure stability of such joints with time and temperature.

Accordingly, there is a need for a method of manufacturing a gage and leadwires with a high degree of precision and strength. Ideally, the attachment of the leadwire to the gage must be mechanically rugged, protected from strain, not load the sensing element when the lead wire is moved, be hermetically sealed, be stable with time, and be stable with temperature.

SUMMARY OF THE INVENTION

The present invention solves the aforementioned problems with the prior art as well as others by providing a method for manufacturing a sensor with an attached leadwire. An adaptor block is fastened to the sheath of a leadwire in a manner to allow a short stub of the leadwire to protrude from one end of the adaptor block. The stub of the leadwire is placed through an opening in a gage shim. The adaptor block is attached and sealed to the gage shim by brazing or other suitable means, such that the sheath and any insulation of the leadwire are approximately flush with the top side of the gage shim. The individual electrical leads of the leadwire extend through the opening in the shim. A layer of gage insulating material is then deposited onto the surface of the shim in a known manner such as sputtering or vapor deposition to cover the end of the lead wire and any insulation material therein. The individual electrical leads are then polished flush with the surface of the insulating layer. The material making up a sensor, such as a strain gage, the jumper leads and pads are then deposited by conventional sputtering or vapor deposition methods, and defined using standard pattern definition techniques such as photolithography. One or more passivation layers are then applied over the entire upper surface of the sensor to provide a complete seal.

For use, the leadwire end is bent at an angle of preferably about 90° with respect to the plane of the gage shim. The adaptor block is then secured to a work surface where a measurement is required, and the gage shim is welded to the surface using normal strain gage spot welding techniques.

An object of the present invention is to provide a method for manufacturing a sensor with an attached leadwire.

Another object of the present invention is to provide a sensor manufactured in accordance with the method of the present invention.

A further object of the present invention is to provide a method for manufacturing a sensor with the attachment of the leadwire which is simple in design, rugged in construction, and economical to manufacture.

The various features of novelty characterized in the invention are pointed out with particularity in the claims annexed to and forming a part of this disclosure. For a better understanding of the invention, and the operating advantages attained by its uses, reference is made to the accompanying drawings and descriptive matter in which a preferred embodiment of the invention is illustrated.

DESCRIPTION OF THE PREFERRED EMBODIMENT

Figure 1:
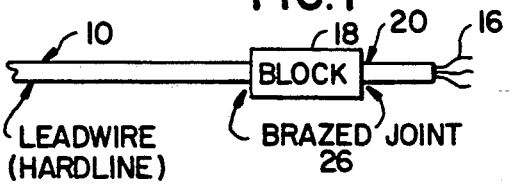
FIG. 1 is an elevated perspective view depicting the leadwire (10) with the attached adaptor block (18) in accordance with the method of the present invention.

Referring to the drawings generally, where like numerals designate like or similar features throughout the several views, there is depicted the steps employed by the present invention in manufacturing a sensor having an attached leadwire. The method of the present invention utilizes existing thin film deposition techniques such as sputtering or vapor deposition. While it is well suited for constructing a thin film strain gage, other sensors may be fabricated using the thin film methods as well as other techniques.

Referring to FIG. 1, there is depicted a portion of a leadwire (10) which has a metallic sheath (12) and mineral oxide insulation (14) therein. In the embodiment shown in FIG. 1, there are three electrical leads or conductors (16) contained within the leadwire (10). Such leadwires are suitable for use on high temperature sensors requiring hermetic sealing and are in fact used on other commercially available high temperature strain gages which use conventional leadwire joining techniques such as welding.

Figure 2:
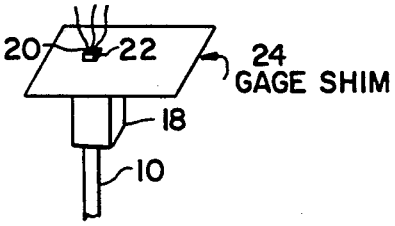
FIG. 2 is a perspective view illustrating the assembly of the gage shim (24) with the adaptor block (18) and leadwire (10) in accordance with the present invention.
Figure 3:
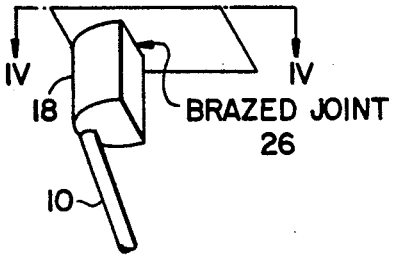
FIG. 3 is an elevated perspective view similar to FIG. 2 showing the attachment of the adaptor block (18) to the bottom side of the gage shim (24)
Figure 4:
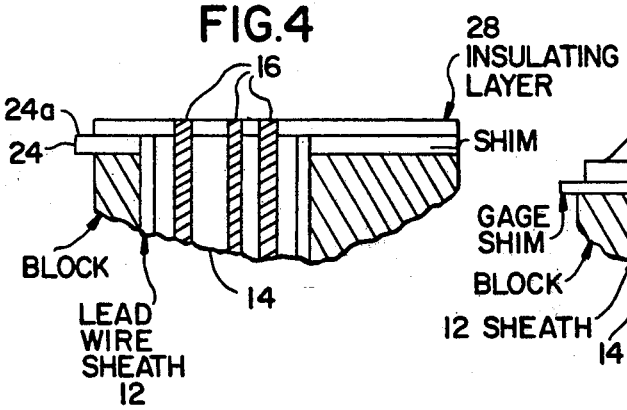
FIG. 4 is a sectional view taken at IV—IV in FIG. 3.
Figure 5:
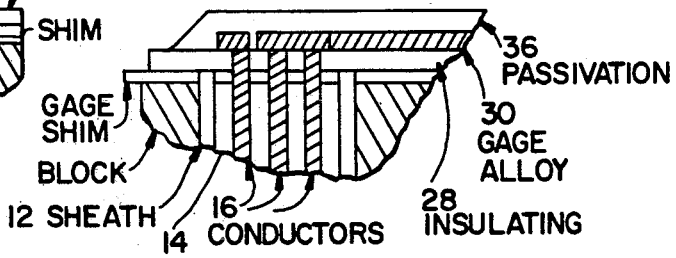
FIG. 5 is a view similar to FIG. 4.

The leadwire (10) is first fastened and sealed to an adaptor block (18) by brazing or other suitable means so that a short stub or portion (20) of leadwire (10) protrudes from one end of the adaptor block (18). Next, referring to FIG. 2, this portion (20) of leadwire (10) is placed through a close fitting opening or hole (22) in a gage shim (24). The adaptor block (18) is attached and sealed to the gage shim (24) by brazing or other suitable means. The brazed joints are generally depicted as (26). The adaptor block (18) is attached to the gage shim (24) such that the metallic sheath (12) and any insulation material (14) in the leadwire (10) are approximately flush with the top side (24*a*) of the shim (24). The electrical leads (16) extend above it as best seen in FIGS. 4 and 5.

An insulating layer (28) is then sputtered or vapor deposited onto the top surface (24*a*) of the shim (24). This insulating layer is of a known material in this art and may be provided in any known fashion to cover the end of the leadwire sheath (12) and any insulation material (14). The individual electrical leads (16) are then polished flush with the surface of the insulating layer (28).

The materials or gage alloy for the strain gage or sensor, jumper leads and pads are then prepared by ion plating, conventional sputtering, evaporation, or other physical vapor deposition techniques, plasma-assisted CVD, or chemical vapor deposition (CVD) or thick-film methods and defined using standard pattern definition techniques such as photolithography as is known in this art. The sensor (30) is deposited in a fashion that connects the electrical leads thereto. One or more passivation layers (36) of suitable materials, which may be high temperature materials to protect the strain gage against contamination, mechanical damage, corrosion and erosion in a particular operating environment, are applied over the upper surface of the entire sensor to provide a complete seal.

The first such passivation layer is necessarily a dielectric material which may be the same insulating material as the insulating layer (28) or may be a different dielectric material; subsequent layers may be either dielectric or metallic or both depending on the particular application environment.

Figure 6:
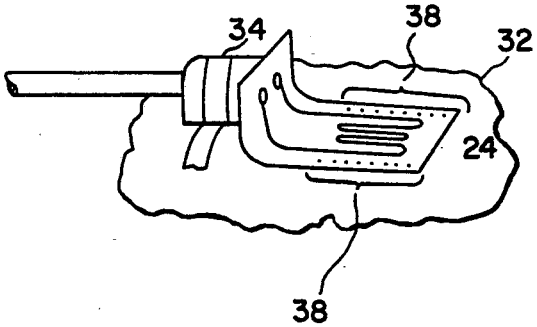
FIG. 6 is a perspective view of the completed sensor in place on a work surface.

As shown in FIG. 6, the end of the shim (24) with the adaptor block attached is bent at an angle of preferably about 90°. The adaptor block (18) is then secured to a work surface where a measurement is required by a band (34) or any other suitable means like welding, brazing or adhesive bonding. The gage shim (24) is then attached to the work surface (32) using normal strain gage spot welding techniques (38), or other suitable means.

From the foregoing, it is seen that the advantages of the present invention over the conventional leadwire attachment techniques include the following. The sensor alloy is directly deposited on the end of the electrical leads to provide an intimate and strong joint. The joint does not have added material which would lead to stress concentration in the electrical leads or gage. The joint between the leadwire and the sensor does not contain foreign metallic materials. This minimizes thermal offsets and drift with time. There are no fluxes or other potentially corrosive materials introduced into the joint. This results in increased joint stability and life. The process temperatures employed in the present invention are low so that the metallurgical changes are not a problem either in the joint or the base materials adjacent to the joint. The insulating and passivation layers which are normally used to insulate and protect the gage insulate and protect the leadwire attachment as well.

It should be apparent that leadwires of other types than that described could readily be employed provided that they may be affixed and sealed to the back surface of the gage shim. Likewise, other joining and sealing processes such as adhesive bonding could readily be used for the attachment of the leadwire in the block. The joining and sealing functions could be done separately using different processes, for example, staking for mechanical strength, followed by an elastomeric sealant. The fixing and sealing steps of the wire to the block and the block to the gage shim could be done simultaneously or in reverse order while still accomplishing the same results.

In some applications, it may be advantageous to use an insulator at the end of the leadwire to provide precise control of the position of the individual leads and to provide a good physical surface to promote the adhesion of the thin film insulating layer.

The gage shim may be preformed to the final configuration prior to any depositions, particularly when using physical or chemical vapor deposition processes. This permits the use of desirable insulating and passivating materials which are not sufficiently ductile to survive a subsequent bending operation. While a right angle is shown between the mounting shim and the plane of the face of the leadwire connection, it is apparent that in some cases oblique angles may be desirable and could readily be accomplished with the method described.

While a specific embodiment of the invention has been shown and described in detail to illustrate the applications and principles of the invention, certain modifications and improvements will occur to those skilled in the art upon reading the foregoing description. It is thus understood that all such modifications and improvements have been deleted herein for the sake of conciseness and readability, but are properly within the scope of the following claims.

I claim:

1. A method for manufacturing a sensor with an attached leadwire having a sheath and electrical leads, comprising the steps of:

fastening an adaptor block to the sheath of the leadwire with a portion of the leadwire extending beyond an edge of the adaptor block;

positioning the extended portion of the leadwire into an opening in a gage shim having top and bottom sides;

attaching the adaptor block to the bottom side of the gage shim such that the sheath of the leadwire is approximately flush with the top side of the gage shim and the electrical leads protrude therethrough;

covering the top side of the gage shim with an insulating layer such that the electrical leads are approximately flush therewith; and depositing a sensor on the insulating layer and connecting the sensor to the electrical leads.

2. A method according to claim 1, further comprising the step of sealing at least an upper surface of the manufactured sensor with at least one passivation layer.

3. A sensor manufactured in accordance with the method of claim 1.

4. A method according to claim 1, further comprising the step of bending the end of the gage shim with the attached adaptor block to an angle with respect to the plane of the gage shim.

5. A method according to claim 4, further comprising the step of welding the gage shim to a work surface.

6. A sensor manufactured in accordance with the method of claim 4.

7. A method according to claim 4, wherein the angle is about 90° degrees.

8. A method according to claim 1, wherein the depositing step provides a thin film sensor.

9. A method according to claim 1, wherein the sensor is a strain gage.

10. A method according to claim 1, wherein the sheath is made from metallic material.

* * * * *